US008066186B2

(12) United States Patent
Kidwell

(10) Patent No.: US 8,066,186 B2
(45) Date of Patent: Nov. 29, 2011

(54) CONFIDENTIALITY PACKAGING SYSTEM

(76) Inventor: John P. Kidwell, Alpharetta, GA (US)

( * ) Notice: Subject to any disclaimer, the term of this patent is extended or adjusted under 35 U.S.C. 154(b) by 0 days.

(21) Appl. No.: 12/478,001

(22) Filed: Jun. 4, 2009

(65) Prior Publication Data

US 2009/0301921 A1 Dec. 10, 2009

Related U.S. Application Data

(60) Provisional application No. 61/059,057, filed on Jun. 5, 2008.

(51) Int. Cl.

| | |
|---|---|
| ***B65D 90/00*** | (2006.01) |
| ***B65D 1/24*** | (2006.01) |
| ***B65D 77/00*** | (2006.01) |
| ***B65D 5/52*** | (2006.01) |
| ***B65B 41/18*** | (2006.01) |
| ***B42D 15/10*** | (2006.01) |
| ***G06K 7/00*** | (2006.01) |

(52) U.S. Cl. ..... 235/462.01; 220/495.01; 220/500; 206/736; 206/216; 53/70; 283/72

(58) Field of Classification Search ..... 235/462.01–462.49; 206/216, 206/736; 220/495.01, 500; 53/70; 283/72
See application file for complete search history.

(56) References Cited

U.S. PATENT DOCUMENTS

| | | | | |
|---|---|---|---|---|
| 3,918,631 | A | 11/1975 | Hackenberg | |
| 4,955,469 | A | 9/1990 | Hudspith | |
| 5,293,994 | A | 3/1994 | Antik | |
| 5,777,305 | A * | 7/1998 | Smith et al. | 235/380 |
| 6,070,719 | A * | 6/2000 | Pollock | 206/232 |
| 6,220,439 | B1 | 4/2001 | Virvo | |
| 6,454,095 | B1 | 9/2002 | Brisebois et al. | |
| 6,631,578 | B2 * | 10/2003 | Key | 40/638 |
| 6,688,466 | B2 | 2/2004 | White et al. | |
| 7,523,825 | B2 | 4/2009 | Velasquez et al. | |
| 2001/0030234 | A1 * | 10/2001 | Wiklof | 235/383 |
| 2003/0102238 | A1 * | 6/2003 | White et al. | 206/438 |
| 2005/0137940 | A1 * | 6/2005 | Lindsay | 705/26 |
| 2007/0045144 | A1 | 3/2007 | Wheeler et al. | |
| 2007/0144929 | A1 | 6/2007 | Minerath, III et al. | |
| 2009/0188210 | A1 * | 7/2009 | Blocker | 53/411 |

* cited by examiner

*Primary Examiner* — Michael G Lee
*Assistant Examiner* — Laura Gudorf
(74) *Attorney, Agent, or Firm* — Shewchuk IP Services, LLC; Jeffrey D. Shewchuk

(57) ABSTRACT

A packaging system uses marked, specially designed packaging to enable confidential purchasing of consumer goods. Products having a first configuration normally labeled for sale are convertible into a second configuration which conceals the identity of the goods, other than perhaps having a confidentiality brand. The confidentiality package is bar-coded for price and purchase scanning but does not identify the type of good(s) being purchased either at the cash register or on the customer's receipt. The confidentially packaged items, which could be marketed under a YOURS CONFIDENTIALLY brand name, for instance, are primarily sold at a retail location immediately next to a normally marked, identical (except for the outer packaging shell) item, and have a brief description of what the item is directly under it (Tampons for example) located in the shelf strip next to the re-order shelf tag.

14 Claims, 7 Drawing Sheets

CONFIDENTIALITY PACKAGING SYSTEM

CROSS-REFERENCE TO RELATED APPLICATION(S)

This application claims priority from Provisional Application No. 61/059,057, filed Jun. 5, 2008, entitled CONFIDENTIALITY PACKAGING SYSTEM.

BACKGROUND OF THE INVENTION

The present invention relates to packaging of consumer products for purchase.

For today's consumer, the grocery store, drugstore and superstore are still the primary purchasing venues for their personal and hygiene product needs. For many consumers purchasing personal and hygiene products, the in-store experience can range from mildly awkward, to somewhat uncomfortable, to down right embarrassing. The fact is, it is a situation born of necessity—not choice—and it is a pattern that can change, when given a better alternative. Market research suggests that 94% of all consumers have experienced an awkward, uncomfortable and/or embarrassing feeling when purchasing one or more personal products during their lifetime.

Several prior art packaging methods seek to address the fact that consumers, for at least some products and at some times, would like to keep various aspects of their purchase including the type of product being purchased confidential from other shoppers or after leaving the store. These prior art methods include packages that are convertible from a first configuration, wherein certain textual or graphical information about the product is displayed, to a second configuration, wherein that textual or graphical information is hidden or removed. For example, U.S. Pat. Nos. 3,918,631, 4,955,469, 5,293,994, 6,220,439, 6,688,466 and 7,523,825, as well as U.S. Patent Publication Nos. 2007/0045144 and 2007/0144929 all disclose convertible packages intended to alternatively display textual or graphical information and then in a different configuration hide that information.

In some instances, the intent to hide the information is associated with gift giving, wherein the alternative "information hidden" configuration also provides a decorative, gift-wrap appearance to the product. In other instances, the intent to hide the information is associated with providing a decorative dispenser during storage and/or use of the item(s). In other instances, the intent is to provide advertising in greater detail in one configuration than another. In yet other instances, the intent to hide the information is due to the embarrassment of the purchaser as to the type of item being purchased, including personal care articles such as incontinence articles, diapers and feminine hygiene products.

While such convertible packages provide confidentiality benefits in some respects, in other respects the confidentiality benefits and packaging are distinctly lacking. A better system of confidentiality packaging is needed.

BRIEF SUMMARY OF THE INVENTION

The present invention is a packaging system, and marked, specially designed packaging to enable confidential purchasing of consumer goods. In general terms, products identified and labeled for sale are further packaged in a convertible outer portion or layer of packaging material which can include a confidentiality branded label but otherwise conceals the identity the type of good(s) within the package. The confidentiality package is bar-coded or otherwise machine readable for purchase/price scanning, but does not identify the type of good(s) being purchased in a human-readable way either at the cash register or on the customer's receipt if such receipt can be viewed by others. The confidentially packaged items are primarily sold at a retail location immediately next to a normally marked, identical (except for the outer confidentiality packaging shell) item. Several different inventive types of confidentiality packaging can be simultaneously used on different products.

DESCRIPTION OF PREFERRED EMBODIMENT(S)

Figure 2:
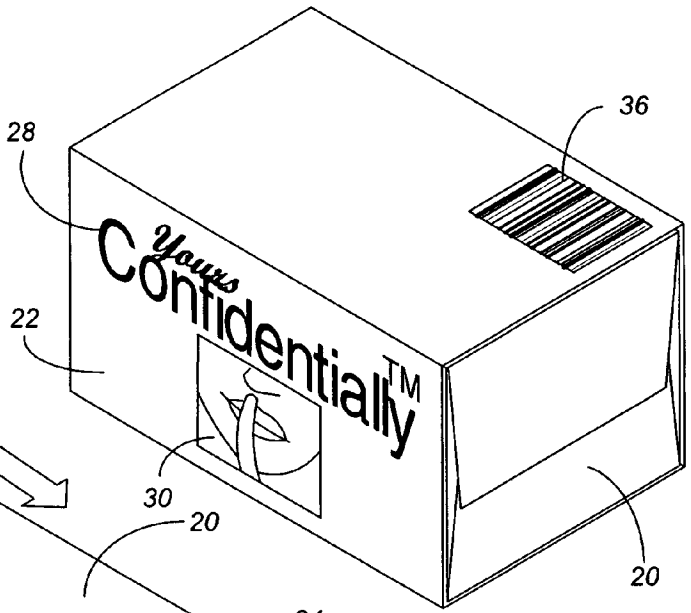
FIGS. 1 and 2 are perspective views of one preferred embodiment of confidentiality packaging in accordance with the present invention.
Figure 1:
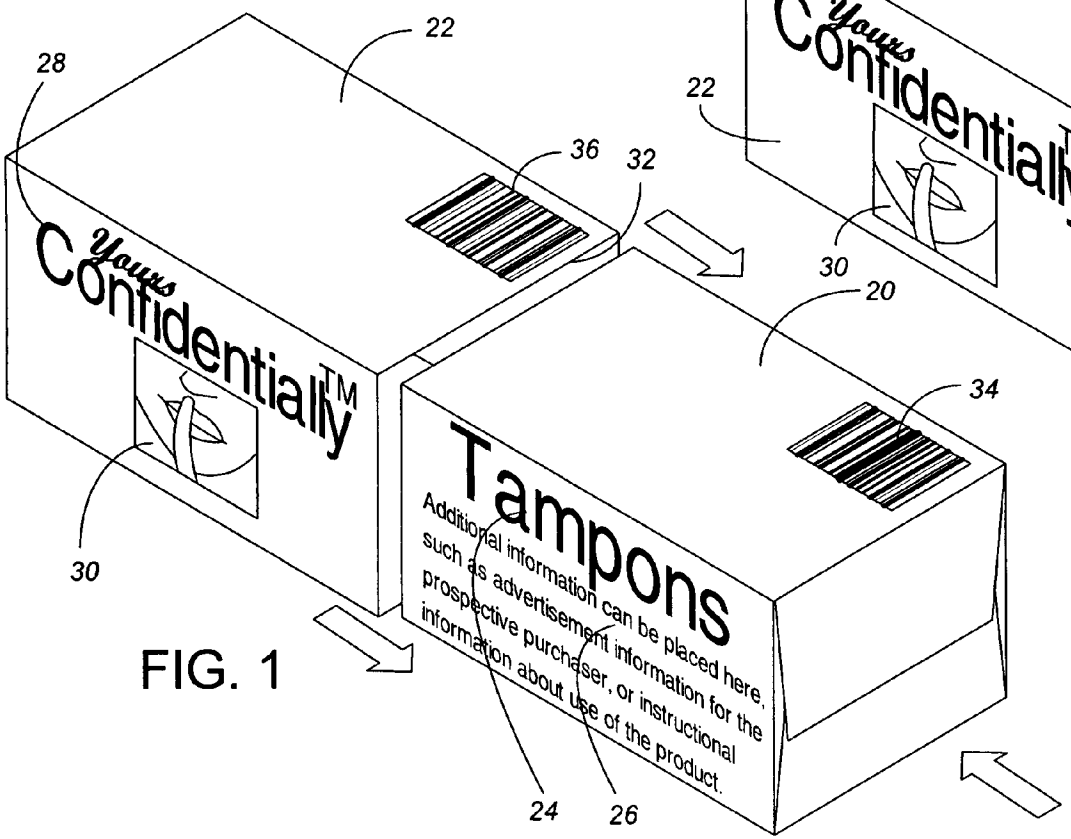

FIGS. 1 and 2 show a first embodiment, in which a box 20 of tampons, labeled for consumer identification and sale, is received in a slightly larger packaging sleeve 22 which has been confidentiality marked. The box 20 of tampons includes a name 24 of the items within the box 20, as well as optionally further information 26 as is conventionally placed on tampons boxes. For instance, the further information 26 can include quantity, size, brand, instructions, ingredients, labeling and/or similar information. Additionally, the further information 26 can include instructions about how to modify the package to achieve confidentiality, i.e., in this embodiment instructions about how to use the confidentiality sleeve 22. The larger packaging sleeve 22 fits snugly over the box 20 of tampons, covering the item name 24 and further information 26 about the product. If desired, the further information 26 can include a website address directing consumers to an on-line location where they can review various information.

The preferred website lists all confidentiality packaged personal items, provides product reviews and test comparisons for their specific type of confidentiality packaged products versus the leading brands including in-home usage test results and laboratory tests, provides product usage information, medical information or user manuals, allows users to view commercials, and provides other useful consumer information. The packaging sleeve 22 preferably includes branding information, such as a trademark 28 and a logo 30, associated with the intent to keep the identity of the goods within the packaging sleeve 22 confidential from others in the store, including store personnel. In this case and as displayed in the Figures, the trademark 28 is YOURS CONFIDENTIALLY and the logo 30 is a person's finger over her mouth shaped as making the "SHHHH" sound and gesture. Thus, in a first configuration with the packaging sleeve 22 removed, the identity of the consumer item is human-readable on its exterior of the packaging. In a second configuration with the packaging sleeve 22 in place, there is no human-readable indication of the identity of the consumer item displayed on the exterior of the packaging.

The packaging sleeve 22 includes at least one, and more preferably two open ends 32, which define the insertion axis of the box 20 of tampons. With one open end 32, only one of the six sides of the box 20 of tampons remains displayed after insertion within the packaging sleeve 22. With two open ends 32, the packaging sleeve 22 can be easily and quickly slid over the box 20 of tampons, without trapping any air within the sleeve 22, while leaving two of the six sides of the box 20 of tampons displayed. When the box 20 of tampons is within the packaging sleeve 22, the packaging sleeve 22 obscures the name 24 of the items and the further information 26. The packaging sleeve 22 with two open ends 32 is thus particularly appropriate when the box 20 of tampons contains no human-readable identifying information on either of the two remaining displayed ends of the box 20 of tampons. The packaging sleeve 22, once placed over the box 20 of tampons, thus confidentially prevents anyone viewing in the shopping cart from knowing that the purchaser is buying a box of tampons.

In one preferred embodiment of the inventive system, the packaging sleeve 22 is placed over the box 20 prior to placement in the store display. The confidentially packaged box of tampons can be placed to immediately adjacent to the national brand leader (e.g., the confidentially packaged box of tampons shown in FIG. 2 would be displayed to the right of TAMPAX). With the sleeve 22 confidentially covering the identifying information 24, 26, the customer is able to identify which product is contained either by removing the confidentiality sleeve 22 or due to proximity of the confidentiality package relative to other, non-confidential but otherwise similar product.

Further, because the confidentiality packaged box 20 of tampons does not show a picture, written description or name of the product on the outside of the packaging sleeve 22, a special shelf tag (not shown) will be placed (directly below the product on the shelf strip) to provide the identity of what the product is (e.g., TAMPONS in bold letters would be listed directly under the confidentially packaged box of tampons shown in FIG. 2). This is in contrast to conventional current shelf tags, which have small print and are used for reordering & restocking only, showing the name of the product, UPC Code and pricing, but not listing in bold letters what the product is.

An additional store display alternative is to place a removable sticker (not shown) on the confidentiality packaged item, such as on the outside of the packaging sleeve 22, which includes the product identifying name 24 and perhaps some or all of the additional information 26. That is, in such a sticker embodiment, the product identifying name 24 and perhaps some or all of the additional information 26 would be provided twice, once on a removable exterior sticker and once on the interior box 20 within the packaging sleeve 22. When the consumer selects the item from the shelf, the consumer removes any such sticker and places the confidentiality packaged item in his or her shopping cart. After removal, the consumer may then retain or discard the sticker. After check-out, the interior box 20 within the confidentiality sleeve 22 still identifies the product and provides information to the consumer for reading in confidence outside the store. Such removable stickers could also be used with any of the other confidentiality packaging embodiments discussed below.

In the embodiment shown in FIGS. 1 and 2, the box 20 of tampons includes a UPC bar code 34 on one of the sides covered by the confidentiality sleeve 22. The confidentiality sleeve 22 includes a different UPC bar code 36 (i.e., the confidentiality bar code), preferably in generally the same location to overlie the UPC bar code 34 on the box 20 of tampons. Thus, by placing the box 20 of tampons into the confidentiality sleeve 22, the UPC bar code 36 on the confidentiality packaging sleeve 22 hides the UPC bar code 34 of the underlying box 20 of tampons and a different UPC bar code 36 is on the exterior of the package. By having a different, confidentiality bar code 36, the merchant is allowed to have a different check-out display and a different receipt than would be provided with the box 20 of tampons if sold without the confidentiality sleeve 22, further explained below with reference to FIGS. 13-15. However, both in the first configuration and in the second configuration, the UPC bar code 34, 36 is a machine-readable marking identifying the contents.

Particularly with the UPC bar codes 34, 36 in this overlying position, a second preferred embodiment of the inventive system includes packaging sleeves 22 which are made available in the store, such as a stack of folded packaging sleeves 22 immediately adjacent the store display of the tampons boxes 20. Those consumers who desire confidentiality may then themselves insert the box 20 of tampons into the packaging sleeve 22. Any other consumers who do not desire confidentiality need then not use the packaging sleeve 22. The use of confidentiality packaging sleeves 22 in this way has a lower cost, as some boxes 20 of tampons are sold without confidentiality packaging sleeves 22 and there is no assembly cost to the merchant or product manufacturer of inserting boxes 20 into sleeves 22 as this assembly step is performed by the purchaser.

In a different embodiment than that shown in FIGS. 1 and 2, the confidentiality packaging sleeve has no UPC bar code, and the box of tampons includes a UPC bar code positioned to correspond to the open end 32 of the packaging sleeve, i.e., displayed both when the box of tampons is within the packaging sleeve and when the box of tampons is removed from the packaging sleeve. The use of confidentiality packaging sleeves in this way allows confidentiality packaging sleeves to be used with appropriately sized products of any other manufacturers, i.e, such as with a TAMPAX box of tampons, provided the UPC bar code for the TAMPAX box of tampons is on a side of the box without other identifying information (possibly including without an identifying color scheme). Alternatively, if existing boxes of tampons from different manufacturers contain product identifying information 26 on the side of the box with the UPC bar code, the confidentiality packaging sleeve can have a small window (not shown) either cut out or with transparent film positioned over the UPC bar code 24, so only the UPC bar code 24 is displayed through the confidentiality packaging sleeve.

Regardless of whether the UPC bar code is on the confidentiality packaging sleeve 22 or left displayed on the box 20 of tampons, the important aspect is how the confidentiality bar code 36 is handled at check-out, as will be explained further with respect to FIGS. 13-15. Once the box 20 is slid into the packaging sleeve 22, others (such as other customers in the check out line and the store clerk) cannot identify what product is being purchased.

The present invention is not limited to using a UPC bar code for the machine-readable marking, and newer technologies such as RFID tags or similar markings may be used for machine reading the identity of the product. However, UPC bar codes are a commonly used, relatively inexpensive mechanism for rendering the contents of the package machine readable while simultaneously not being human-readable.

Figure 4:
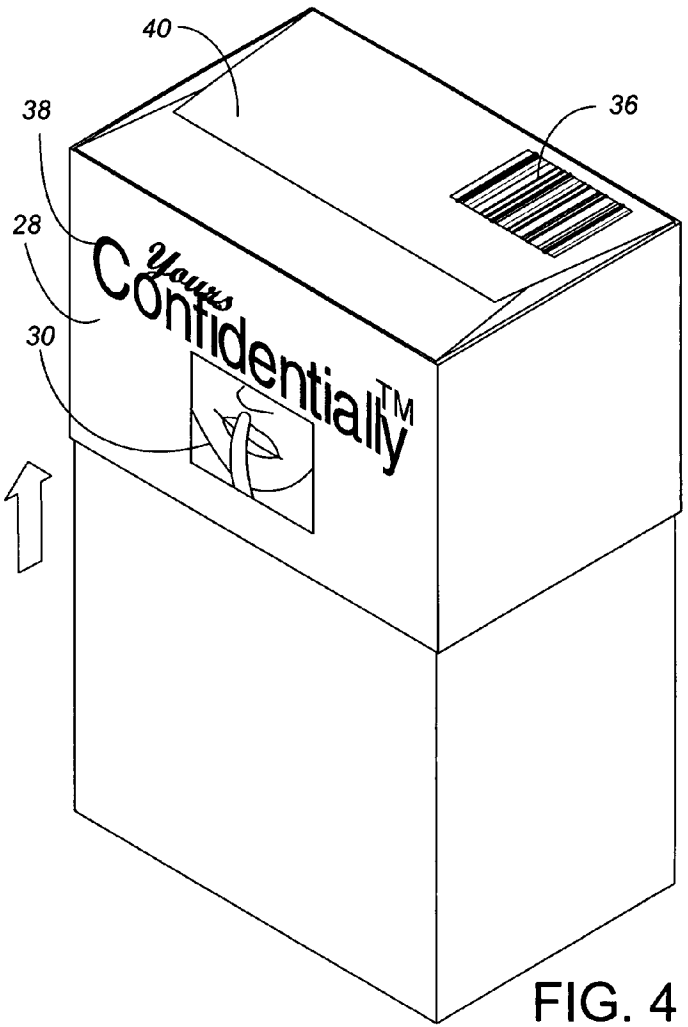
FIGS. 3 and 4 are perspective views of a second preferred embodiment of confidentiality packaging in accordance with the present invention.
Figure 3:
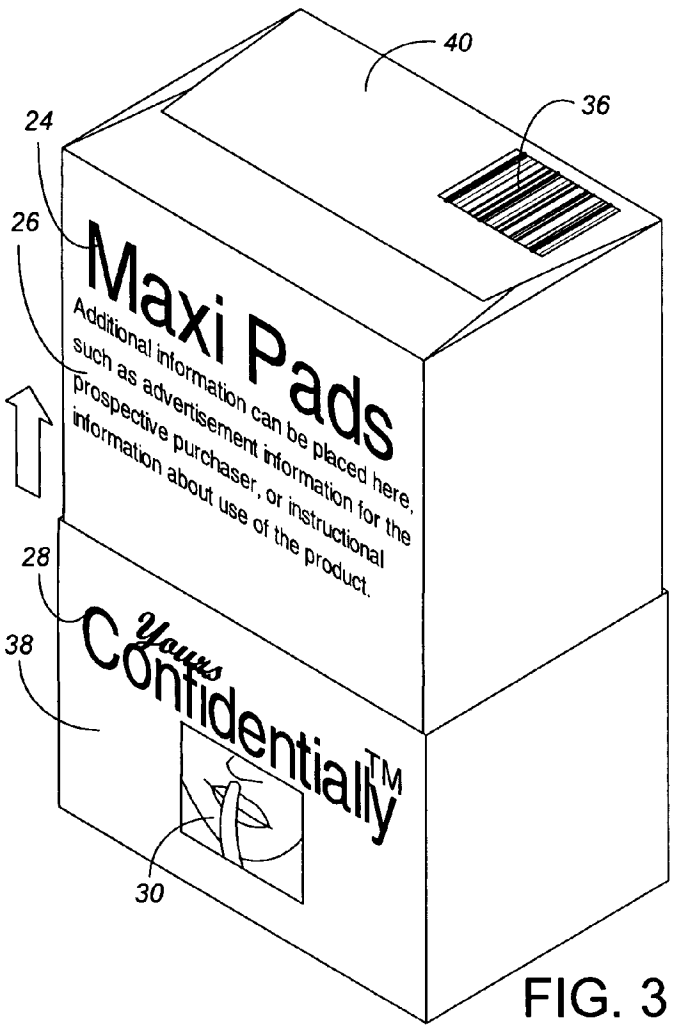

FIGS. 3 and 4 show a second embodiment of the present invention, in which the confidentiality sleeve 38 is a less separate, more integral part of the packaging of the product. In this embodiment, the package includes a sliding sleeve 38 which covers about half of four sides of the outer surface of the box 40. When the confidentiality sleeve 38 is in a first position (FIG. 3), such as while the package is on the store shelf, the product identification information 24, 26 can be viewed by the customer. In this case, the items within the box 40 are Maxi Pads, and the name 24 of the items within the box 40 as well as optionally further information 26 are shown in FIG. 3. When the customer makes his or her purchasing decision, the customer slides the confidentiality sleeve 38 upward to a second position (FIG. 4). With the confidentiality sleeve 38 in this upward second position, others cannot identify what product is being purchased when that product is in the customer's shopping cart and in the check-out lane. In the preferred embodiment, the confidentiality sleeve 38 is secured to the box 40 of Maxi Pads and cannot be non-destructively removed from the box 40 of Maxi Pads.

The UPC bar code 36 for this second embodiment of FIGS. 3 and 4 could be on the sliding confidentiality sleeve 38, or may be on an end of the box 40 as shown in FIGS. 3 and 4. That is, with the confidentiality sleeve 38 as a permanent, secured part of the product packaging, only one UPC bar code 36 is present rather than two different UPC bar codes 34, 36.

Figure 6:
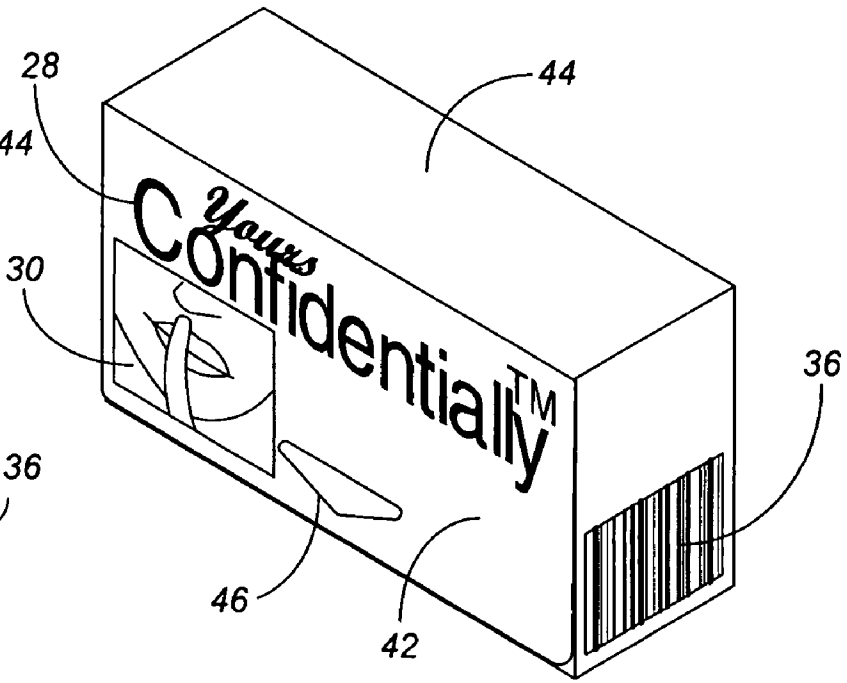
FIGS. 5 and 6 are perspective views of a third preferred embodiment of confidentiality packaging in accordance with the present invention.
Figure 5:
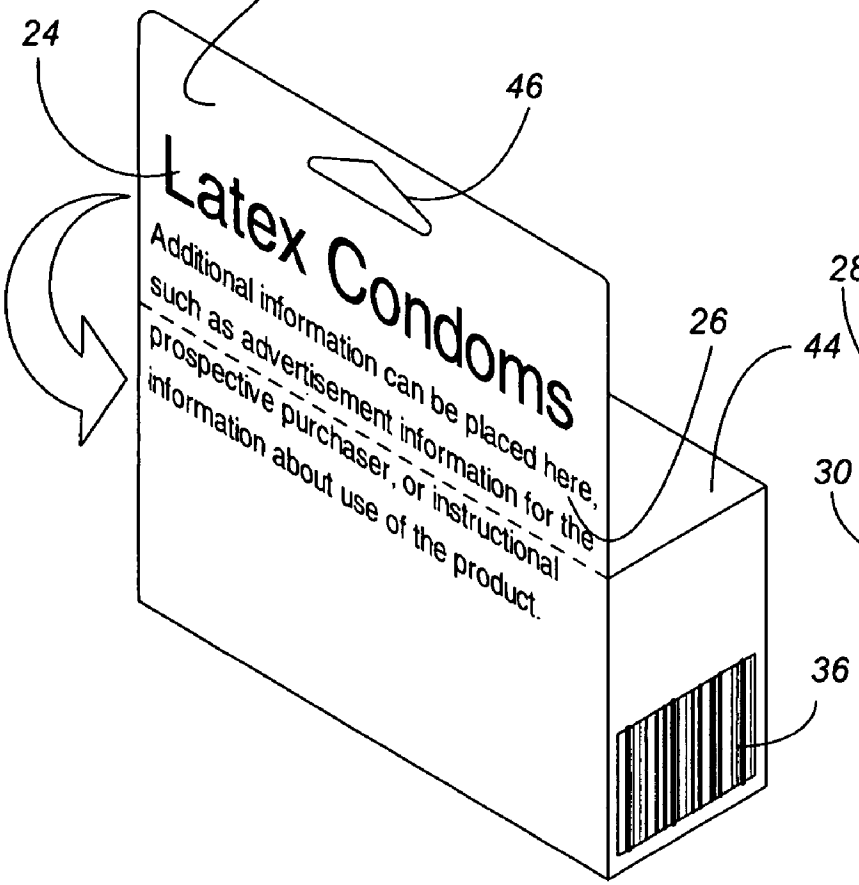

FIGS. 5 and 6 show a third embodiment. In this embodiment, the identifying information 24, 26 for the product is on a flap 42 of the package 44, such as the flap 42 having an opening 46 used to support the package 44 from a display rod (not shown). The flap 42 extends from the box 44 in the first position, showing in this case that the items within the box 44 are latex condoms. A clip, flap or even pressure activated adhesive (not shown) can be used so the customer upon selecting the product can secure the flap 42 downward (FIG. 6) so others cannot identify what product is being purchased.

The UPC bar code 36 for this third embodiment of FIGS. 5 and 6 is on the box 44 outside of the flap 42. Again, only one UPC bar code 36 is present rather than two different UPC bar codes 34, 36.

Figure 8:
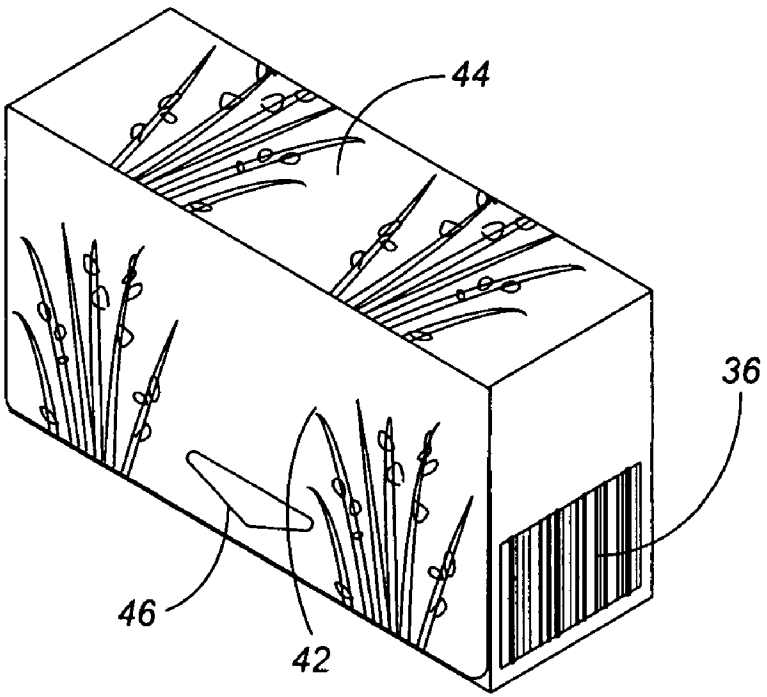
FIGS. 7 and 8 are perspective views of a fourth preferred embodiment of confidentiality packaging in accordance with the present invention.
Figure 7:
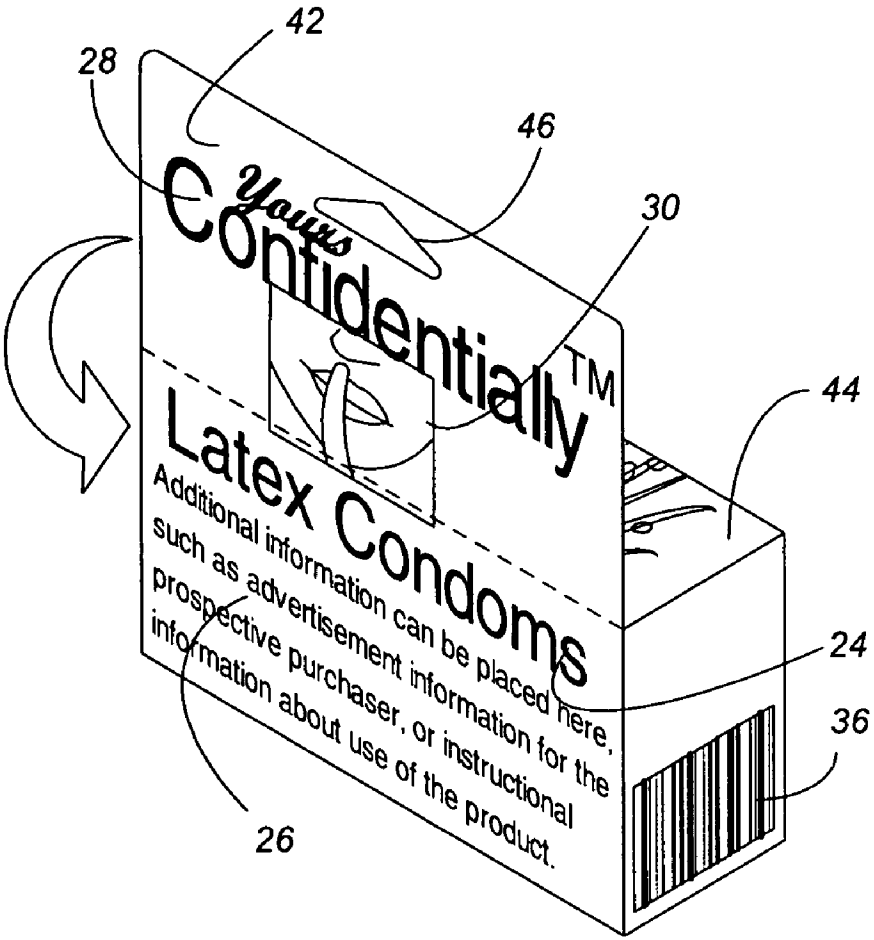

FIGS. 7 and 8 show a modification of this third embodiment. In this modification, the trademark 28 and logo 30 are positioned together with the name 24 of the item and the further information 26, i.e., so they are only shown in the first configuration. When the customer converts the packaging to its confidentiality configuration by folding down the flap 42, no human readable information is shown on the outside of the package. As with all the other embodiments, decorations may be provided on the box 40 which are shown either in the initial configuration or in the converted, confidential configuration.

As additional examples in some ways similar to FIGS. 5-8, certain aspects of the invention can be used with the convertible product packaging shown in U.S. Pat. Nos. 4,955,469, 5,293,994, 6220,439 and 6,688,466. All four of these patents are incorporated by reference. In each instance, the important consideration is that the package is convertible by repositioning an extension from one position wherein the identity of the goods is revealed to a second position wherein the identity of the goods is concealed. A UPC bar code provides a machine-readable marking identifying the consumer item both in the first configuration and second configuration of the packaging.

Figure 10:
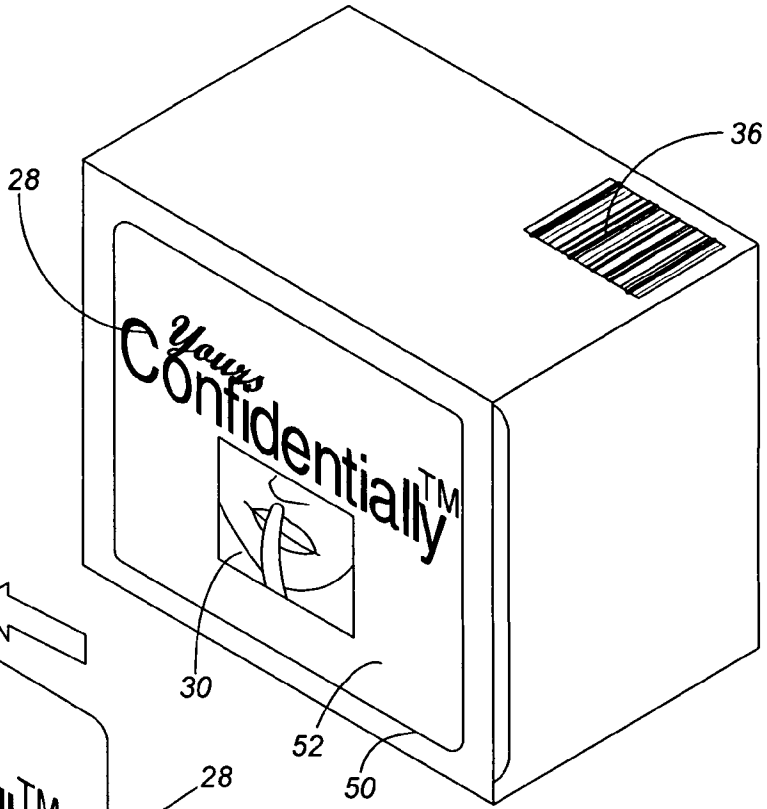
FIGS. 9 and 10 are perspective views of a fifth preferred embodiment of confidentiality packaging in accordance with the present invention.
Figure 9:
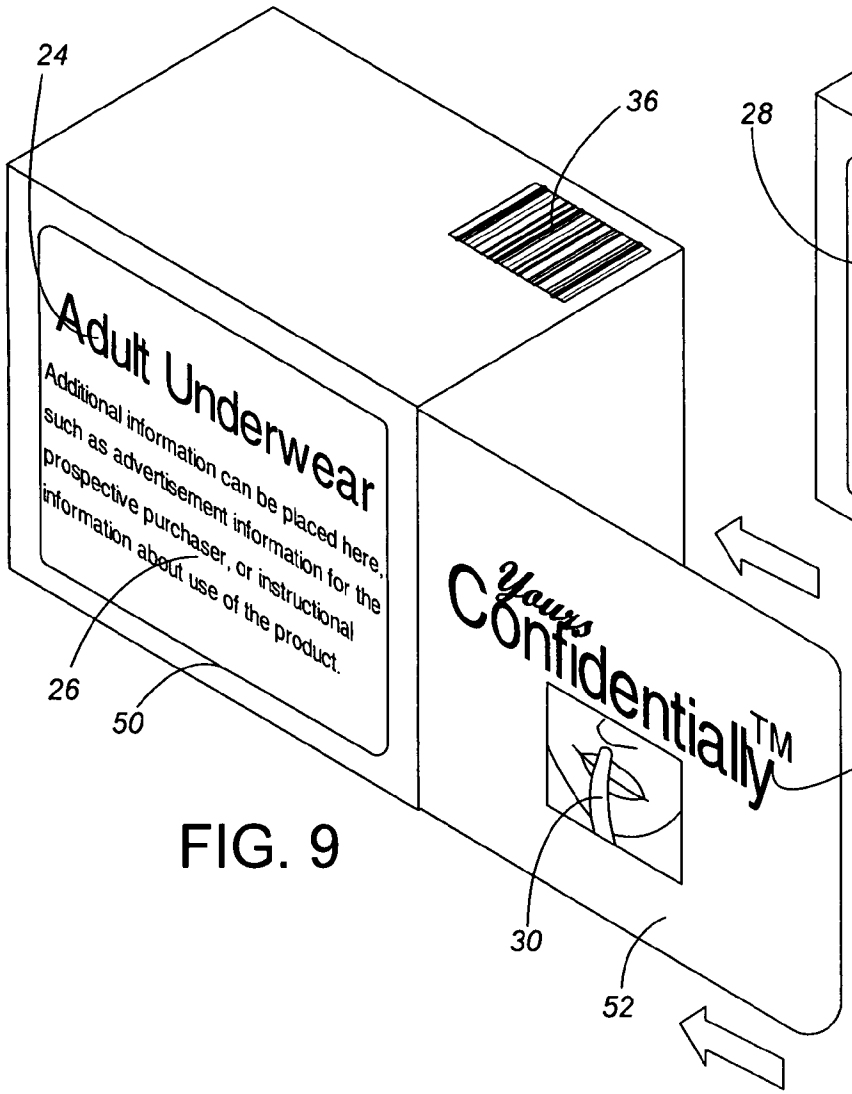

FIGS. 9 and 10 show another embodiment, which in this case is depicted as a box 48 of adult underwear. The box 48 for the item contains a window 50, which could be an opening in the box cardboard or could be covered with a transparent plastic film. The identifying information 24, 26 for the box 48 of adult underwear is shown through the window 50. A confidentiality panel or card 52 slides to be received in the window 50 and cover the identifying information 24, 26 for the package 48. Similar to the embodiment of FIGS. 3 and 4, the confidentiality panel 52 is secured to the box 48 of adult underwear both in the first position (FIG. 9) which identifies the contents of the box 48 and in the second position (FIG. 10) which conceals the contents, and the confidentiality panel 52 cannot be non-destructively removed from the box 48 of adult underwear. The UPC bar code 36 for this embodiment of FIGS. 9 and 10 is on the box 48 other than the side receiving the confidentiality panel 52. Again, only one UPC bar code 36 is present rather than two different UPC bar codes 34, 36.

Figure 12:
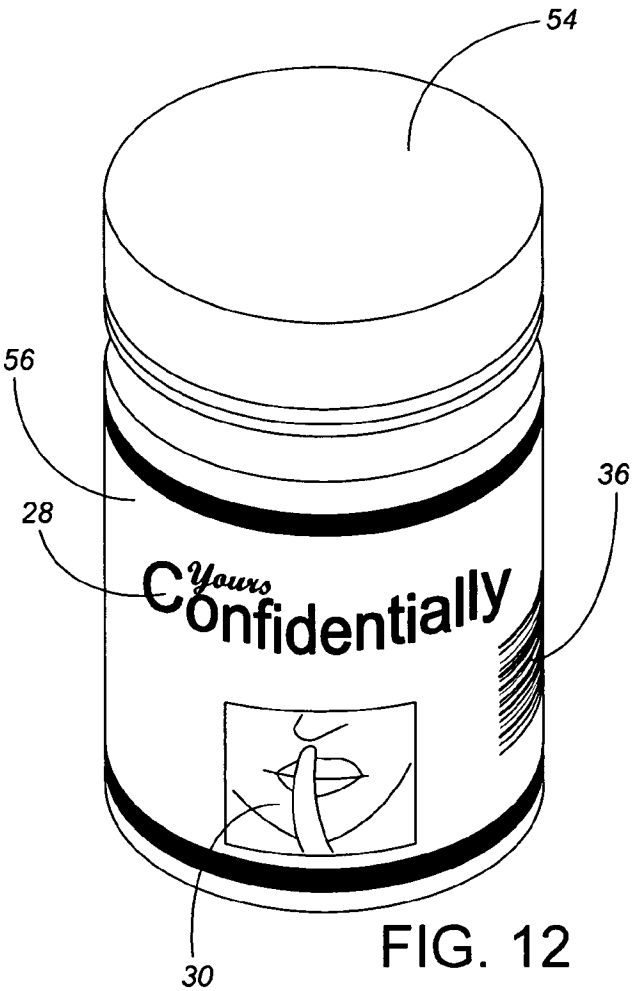
FIGS. 11 and 12 are perspective views of a fourth preferred embodiment of confidentiality packaging in accordance with the present invention.
Figure 11:
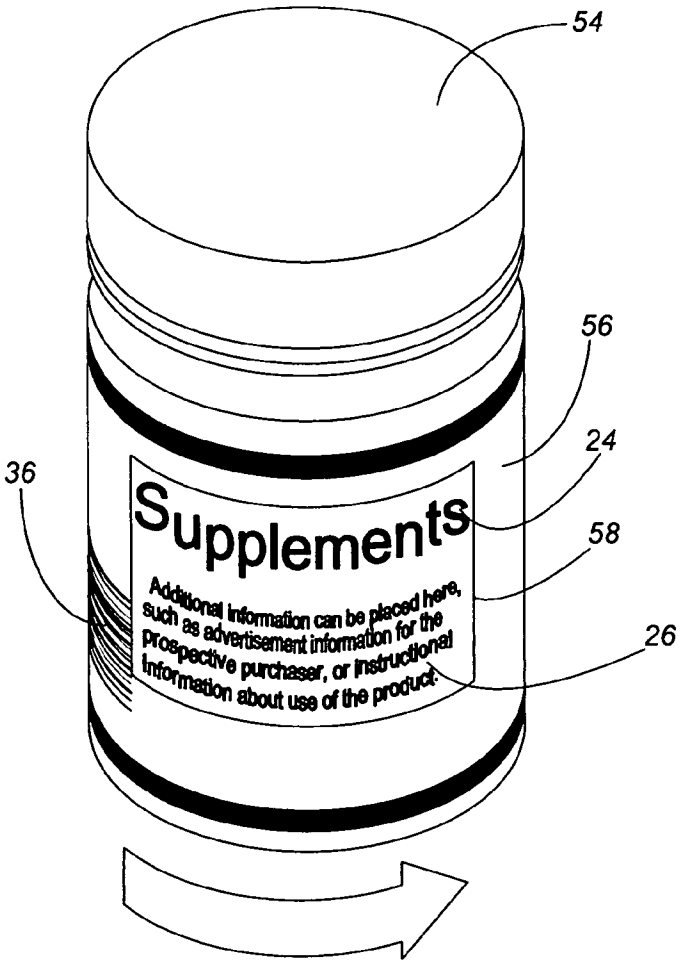

FIGS. 11 and 12 show yet a different embodiment, preferably used with a cylindrical bottle or canister 54. An outer sleeve 56 includes a transparent window 58, and information 24, 26 identifying the product is viewable through the window 58. In this case, the product is a bottle 54 of dietary Supplements. The outer sleeve 56 twists or rotates relative to the bottle 54 and about the central axis of the bottle 54. Once repositioned 180° to its new circumferential position, the outer sleeve 56 conceals the identifying information 24, 26 on the bottle label. The UPC bar code 36 for this embodiment of FIGS. 11 and 12 is on the outer sleeve 56, and thus is always scannable regardless of the circumferential position of the outer sleeve 56.

While the rotatable sleeve 56 is most beneficial for cylindrical containers, it can also be used for rectangular, box-like containers. For instance, the rotatable sleeve 56 might be made of flexible material to permit it to circumscribe a box at a circumferentially changeable position. Alternatively, the rotatable sleeve can be formed like the sleeve of FIG. 1 but with a viewing window therethrough, which is rotatable to a new circumferential position by removing the sleeve from the box 20, rotating the box 20 90, 180 or 270° relative to the sleeve, and reinserting the sleeve onto the box 20. The important aspect is that the rotatable sleeve has a window to permit human-readable container contents in a first circumferential position, but then to have no human-readable indication of the container contents when repositioned to a second circumferential position.

Additional benefits for marketing the personal items contained within the inventive confidentiality packaging are obtained when numerous different items are confidentiality packaged at a store. Namely, consumers at such a store can through repetition quickly and readily understand how the confidentiality packaging concept applies to a wide range of products to effectively conceal what the personal item is to everyone but the person purchasing the product. Thus another aspect of the present invention is that two or more of the different types of disclosed confidentiality packages are simultaneously used at the same store.

Yet another aspect of the present invention is a store within a store concept featuring a separate section of personal products featuring all the confidentiality packaged items in one location of the store. Consumers can shop the confidentiality packaged section, saving consumers time by not having to go aisle to aisle looking for their various confidential needs.

As shown in the examples depicted in the Figures, many different products can be marketed and distributed at retail using the present invention. Examples of leading types of products to use the confidentiality packaging of the present invention include:

1. Feminine Hygiene Products, such as sanitary napkins, tampons, douche products and freshening cloths, FDS, VAGASIL Crème, MONASTAT for yeast infection, or other feminine hygiene products, including generic versions of the listed brand named products;
2. Adult Incontinence Products, such as briefs, undergarments, male and female guards, pads or other adult incontinence products, or children's incontinence products;
3. Other Personal Consumer Goods Items, such as condoms, pregnancy tests, PREPARATION H, KY jelly, IMODIUM AD, BENO gas pills, FLEET ememas, MIDOL, PAMPRIN, URISTAT, or other personal consumer goods items, including generic versions of the listed brand named products;
4. Clothing/Fashion Items, including thong underwear, extended sizes of all clothes without sizes shown on packaging or garment (blue jeans, for example), pads to fill bras, jock straps, or other clothing/fashion items;
5. Greeting Cards That Deal With Personal Topics, such as cancer, divorce, job loss, or being a care giver to one's parents; and/or
6. High Theft Items, such as the personal items that are most frequently taken by theft, with the thought of reducing costs by providing a product that removes the biggest obstacle for purchasing which is embarrassment.

Obviously the confidentiality packaging of the present invention can also be used with a wide variety of other consumer goods.

Figure 14:
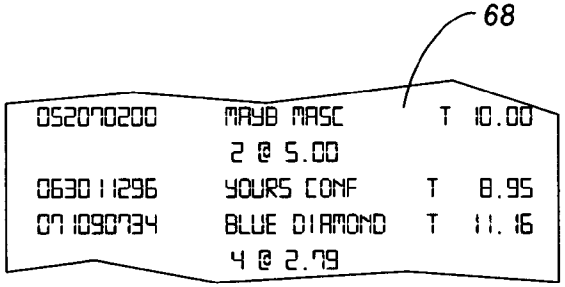
FIG. 14 shows a portion of a receipt generated with a first embodiment of the present invention.
Figure 15:
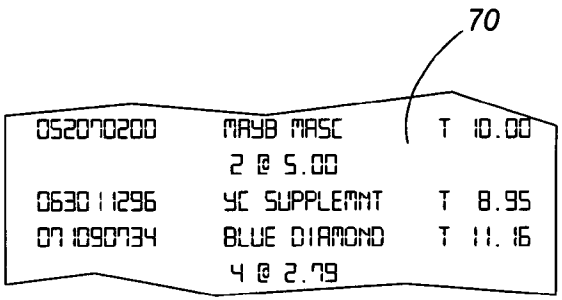
FIG. 15 shows a portion of an alternative receipt generated with a second embodiment of the present invention, which does not represent the cash register display While the above-identified drawing figures set forth preferred embodiments, other embodiments of the present invention are also contemplated, some of which are noted in the discussion. In all cases, this disclosure presents the illustrated embodiments of the present invention by way of representation and not limitation. Numerous other minor modifications and embodiments can be devised by those skilled in the art which fall within the scope and spirit of the principles of this invention.
Figure 13:
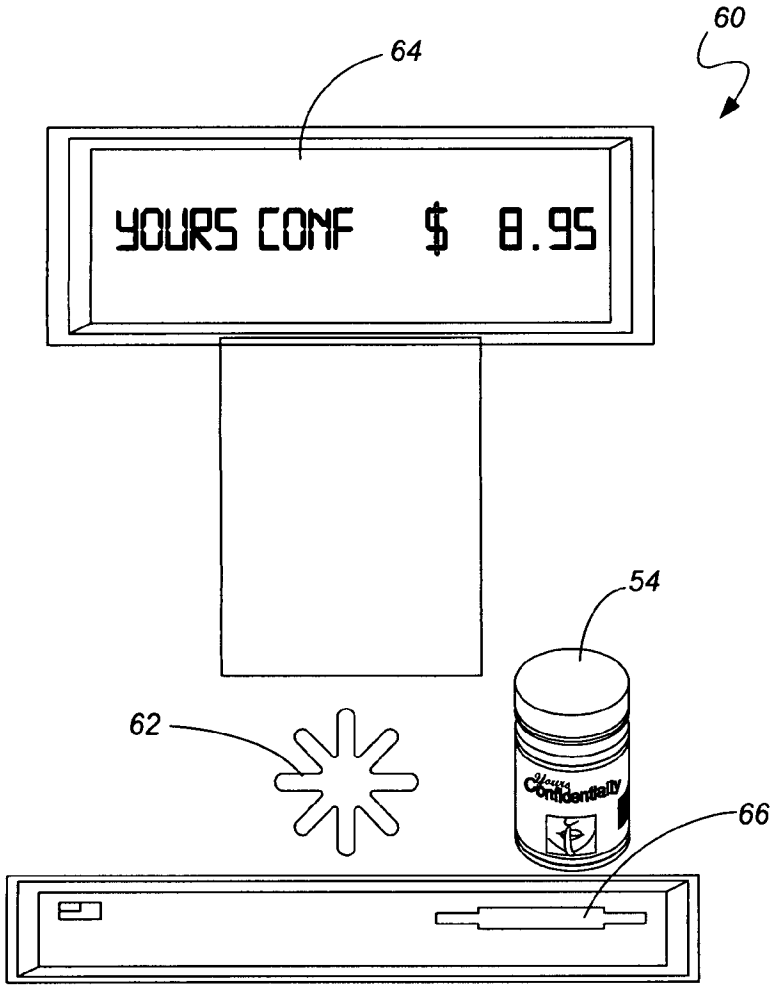
FIG. 13 is a simplified representation of a check-out system using the present invention.

FIGS. 13-15 depict how the packaging of the present invention preferably provides just a part of an overall system, including confidentiality at check-out from both others in the check out line and store clerks. Namely, a check-out location 60 includes a scanner for machine reading the identity of the package, such as a UPC bar code reader 62. The check-out system includes a human-readable display 64 which identifies the consumer items being purchased. Such UPC bar code readers 62 are common in today's grocery and convenience stores, but they generally are not set up as part of a system to maintain privacy and confidentiality over a purchase. In contrast to prior art scanners and displays, the present invention as a system incorporates a database (stored on a computer readable medium 66) which does not show the identity of the confidentiality packaged product on the display 64. Thus, the UPC bar code 36 for the Supplements is tied into a database to display a non-descriptive message when the bottle of confidentiality packaged Supplements is scanned. For instance, in the preferred embodiment, the scanner 62 and display 64 is programmed to read out "Yours Conf" and the price when the UPC bar code 36 for the bottle of confidentiality packaged Supplements is scanned. In contrast to the UPC bar code read out for confidentiality packaged items, other items which are not in confidentiality packaging are still identified at purchase on the human-readable display 64. For instance, if the UPC bar code 34 on the box 20 of tampons of FIG. 1 without the confidentiality sleeve 22 is scanned, the human-readable display 64 would show "TAMPONS".

Depending upon where the paper cash register receipt for the purchase is generated, the system of the present invention may generate a paper cash register receipt 68 such as shown in FIG. 14, wherein the confidentiality packaged Supplements are identified as "063011296 Yours Conf" for the product portion of the receipt 68. The "063011296" number portion of this read out identifies the product to someone knowledgeable about the code, but the readout as a whole represents a confidentiality alias for the product. That is, neither the store clerk nor other consumers viewing the receipt will ordinarily be able to identify which product was purchased. Such confidentiality aliasing is particularly appropriate in situations wherein the store clerk handles the paper receipt 68. Such confidentiality aliasing is also particularly appropriate in situations where there is no large display 64 identifying items as they are scanned, wherein the paper receipt 68 itself represents the only human-readable display generated at check-out. Of course, such confidentiality aliasing can also be used on the read out of the display 64 that is visible to consumers and store personnel at the check-out counter as well as on the paper receipt 68.

In other situations, however, the paper receipt may be provided to the purchaser directly from the system, without the opportunity for reading by the store clerk or other consumers. Such a system is depicted with the paper cash register receipt 70 shown in FIG. 15. In this case, because the paper receipt 70 itself is confidential and not viewed by other purchasers or store personnel, the paper receipt 70 may correctly identify the type of product being scanned and purchased.

The present invention thus addresses the need for privacy and applies this need to maintain confidentiality even to store personnel and check-out clerks as well as other consumers. With implementation of the present invention, all consumers can shop freely and openly without feeling awkward, uncomfortable or embarrassed.

Although the present invention has been described with reference to preferred embodiments, workers skilled in the art will recognize that changes may be made in form and detail without departing from the spirit and scope of the invention.

What is claimed is:

1. A system for confidentiality packaging of consumer items, comprising:

a consumer item;

packaging containing the consumer item, the packaging having a first configuration in which the identity of the consumer item is human-readable on an exterior of the packaging, the packaging having a second configuration in which no human-readable indication of the identity of the consumer item is displayed on the exterior of the packaging, the packaging having a machine-readable marking identifying the consumer item both in the first configuration and second configuration of the packaging;

a machine for reading the machine-readable marking at check-out for purchase of the consumer item, the machine having a human-readable display, wherein consumer items which are not in confidentiality packaging are identified at purchase on the human-readable display, and wherein consumer items which are in confidentiality packaging are not identified at purchase on the human-readable display, wherein the packaging comprises a label circumferentially supported on a container, the label having a first circumferential position in which the identity of the consumer item is human-readable, the label being rotatable about the container to a second circumferential position in which the human-readable identity of the consumer item is concealed, and wherein less human-readable information is presented on the exterior of the packaging in the second circumferential position than in the first circumferential position.

2. The system of claim 1, wherein the packaging comprises a sleeve having an open end and defming an insertion axis, and a container which is axially insertable into and removable from the sleeve at the open end.

3. The system of claim 1, comprising a brand displayed on the packaging in the second configuration.

4. The system of claim 1, wherein the human-readable display is a sales receipt, and wherein the consumer item is listed on the sales receipt under a confidentiality alias.

5. The system of claim 1, wherein the human-readable display is a register display, wherein the machine produces a sales receipt, and wherein the sales receipt identifies the consumer item.

6. The system of claim 1, wherein the machine readable marking is a bar code on the exterior of the packaging.

7. The system of claim 1, wherein the confidentiality packaged consumer item is displayed within a store immediately adjacent an identical consumer item which is not confidentiality packaged.

8. The system of claim 1, wherein the packaging in the second configuration lists a website which provides consumer information about the consumer item.

9. The system of claim 1, wherein a store contains confidentiality packaged items which utilize two or more different forms of confidentiality packaging.

10. A confidentiality packaged consumer item, comprising:

a consumer item;

a container containing the consumer item;

a label circumferentially supported on the container, the label having a first circumferential position in which the identity of the consumer item is human-readable on an exterior of its packaging, the label being rotatable about the container to a second circumferential position in which the human-readable identity of the consumer item is concealed and in which no human-readable indication of the identity of the consumer item is displayed on the exterior of the packaging, wherein less human-readable information is presented on the exterior of the packaging in the second circumferential position than in the first circumferential position; and a machine-readable marking identifying the consumer item both in the first circumferential position and in the second circumferential position of the label.

11. A system for confidentiality packaging of consumer items, comprising:

a consumer item;

a container containing the consumer item, the container having a human-readable identification of the consumer item on an exterior of the container, the container having a UPC bar code on the exterior of the container identifying the consumer item;

a sleeve having an open end and defming an insertion axis, the sleeve having an interior size and shape which mate with the container such that the container is axially insertable into and removable from the sleeve at the open end, the sleeve concealing the human-readable identification of the consumer item but permitting machine-reading of the UPC bar code; and a machine for reading the UPC bar code at check-out for purchase of the consumer item, the machine having a human-readable display, wherein consumer items which are in confidentiality packaging are not identified at purchase on the human-readable display.

12. The system of claim 11, wherein sleeve comprises a window positioned in a face of the sleeve exposing the UPC bar code therethrough.

13. The confidentiality packaged consumer item of claim 10, wherein the label comprises a window, with the identity of the consumer item being human-readable through the window in the first circumferential position, and with no wording being presented through the window in the second circumferential position.

14. The system of claim 1, wherein the label comprises a window, with the identity of the consumer item being human-readable through the window in the first circumferential position, and with no wording being presented through the window in the second circumferential position.

* * * * *